United States Patent [19]

Hauser, Jr.

[11] Patent Number: 4,528,959

[45] Date of Patent: Jul. 16, 1985

[54] SEAL FOR AN INTERNAL COMBUSTION ENGINE

[75] Inventor: Herbert J. Hauser, Jr., Waterloo, Iowa

[73] Assignee: Deere & Company, Moline, Ill.

[21] Appl. No.: 573,236

[22] Filed: Jan. 23, 1984

[51] Int. Cl.[3] ..... F02M 53/04

[52] U.S. Cl. ..... 123/470; 277/236; 277/206 R

[58] Field of Search ..... 123/470, 471; 239/600, 239/533.2–533.12; 277/190, 191, 236, 206 R

[56] References Cited

U.S. PATENT DOCUMENTS

| | | | |
|---|---|---|---|
| 3,038,456 | 6/1962 | Dreisin | 123/470 |
| 3,099,456 | 7/1963 | Hopp | 277/236 |
| 3,207,524 | 9/1965 | Trbovich | 277/236 |
| 3,299,504 | 1/1967 | Hopp | 277/236 |
| 3,431,895 | 3/1969 | Bailey | 123/470 |
| 3,695,235 | 10/1972 | Anderson | 239/533 |
| 3,841,277 | 10/1974 | Schafer | 123/470 |
| 3,920,254 | 11/1975 | Johnston et al. | 277/206 R |
| 3,971,566 | 7/1976 | Levinsohn | 277/236 |
| 4,201,172 | 5/1980 | Gaggle et al. | 123/470 |
| 4,240,385 | 12/1980 | Kulke | 123/47 |
| 4,319,758 | 3/1982 | Nicholson | 277/236 |
| 4,346,679 | 8/1982 | Knowles | 123/145 A |
| 4,422,426 | 12/1983 | Tsugekawa et al. | 123/470 |

FOREIGN PATENT DOCUMENTS

| | | | |
|---|---|---|---|
| 2824476 | 12/1979 | Fed. Rep. of Germany | 123/470 |
| 687248 | 9/1979 | U.S.S.R. | 123/470 |

*Primary Examiner*—Magdalen Y. C. Moy

[57] ABSTRACT

A seal for an internal combustion engine having a fuel injection nozzle positioned within a stepped bore formed in a cylinder head. The fuel injection nozzle contains an exterior stepped configuration with a shoulder formed between its steps. The seal includes a ring circumferentially positioned around and contacting the smaller diameter portion of the fuel injection nozzle. The ring has a flat first end which abuts the shoulder of the fuel injection nozzle and a tapered second end which contacts the smaller diameter portion of the stepped bore. The taper is formed on an exterior surface of the ring and has a maximum outside diameter which is slightly larger than the smaller diameter portion of the stepped bore. The seal also contains an outwardly projecting bulge formed between the first and second ends. The bulge permits the first and second ends to move axially relative to one another as the fuel injection nozzle is axially adjusted within the cylinder head and during normal engine operation. The seal serves to prevent combustion gases, which are generated in the cylinder, from flowing into the larger diameter portion of the stepped bore.

10 Claims, 3 Drawing Figures

SEAL FOR AN INTERNAL COMBUSTION ENGINE

FIELD OF THE INVENTION

This invention relates to a seal for an internal combustion engine and more particularly, to a seal which prevents the passage of combustion gases from the combustion chamber of a cylinder through a stepped bore in which a fuel injection nozzle is located.

BACKGROUND OF THE INVENTION

Over the years, many significant improvements have been made in the design and operation of fuel injection apparatuses for both spark and compression ignition engines. Today, fuel injection nozzles are compact and simple devices having a high degree of efficiency. One of the problems which has been encountered by engineers in incorporating these improved injection devices within internal combustion engines has been the detrimental effect of high temperature cylinder gases acting upon the outlet end of the nozzle. These gases can enter the annular space formed between the nozzle and the surrounding bore and cause heating and carbonization problems.

In order to prevent the bypass of cylinder gases through the annular space between the nozzle and the surrounding bore formed in the cylinder head, engineers have utilized annular seals or gaskets of conventional designs which are sometimes disposed within annular recesses formed circumferentially about the tubular nozzle. One drawback of these seals is that they are not compressible as the fuel injection nozzle is axially aligned within the stepped bore. A second drawback can occur should a height differential exist between the shoulder of the fuel injection nozzle and the step of the stepped bore. This dimensional difference reduces the effectiveness of the seal and permits the passage of combustion gas to the upper portion of the fuel injection nozzle.

Now a seal has been designed which will account for minor dimensional differences which may exist between the shoulder of the fuel injection nozzle and the step of the stepped bore.

SUMMARY OF THE INVENTION

Briefly, the present invention relates to a seal for an internal combustion engine. The engine includes an engine block having a cylinder formed therein and having a cylinder head mounted to the block which closes off one end of the cylinder. The cylinder head has a stepped bore formed therein with a smaller diameter portion communicating with the cylinder and a larger diameter portion located distally from the cylinder. A fuel injection nozzle is positioned within the stepped bore and is secured to the cylinder head in a predetermined axial position. The fuel injection nozzle has an exterior stepped configuration with a shoulder formed between its steps. The seal includes a ring which circumferentially surrounds and contacts the smaller diameter portion of the fuel injection nozzle. The ring has a flat first end which abuts the shoulder of the fuel injection nozzle and a tapered second end which contacts the smaller diameter portion of the stepped bore. The taper is formed on the exterior surface of the ring and has a maximum outside diameter slightly larger than the smaller diameter portion of the stepped bore. The ring also has an outwardly projecting bulge formed between the first and second ends which permits the ends of the ring to move axially relative to one another as the fuel injection nozzle is axially secured to the cylinder head and during thermal expansion. The bulge permits the seal to be compressed to a limited extent thereby preventing combustion gases generated in the cylinder from flowing into the larger diameter portion of the stepped bore.

The general object of this invention is to provide a seal for an internal combustion engine. A more specific object of this invention is to provide a seal for sealing combustion gases generated in a cylinder from flowing to an upper portion of a fuel injection nozzle.

Another object of this invention is to provide a seal which cooperates between a fuel injection nozzle and a stepped bore, formed in the cylinder head, to prevent hot combustion gases from flowing from the cylinder to an upper portion of the fuel injection nozzle.

Still another object of this invention is to provide a simple and economical seal for the fuel injection portion of an internal combustion engine.

A further object of this invention is to provide a compressible seal which accounts for axial dimensional differences between a fuel injection nozzle and a stepped bore in which it is positioned.

Other objects and advantages of the present invention will become more apparent to those skilled in the art in view of the following description and the accompanying drawings.

DETAILED DESCRIPTION OF THE PREFERRED EMBODIMENT

Figure 1:
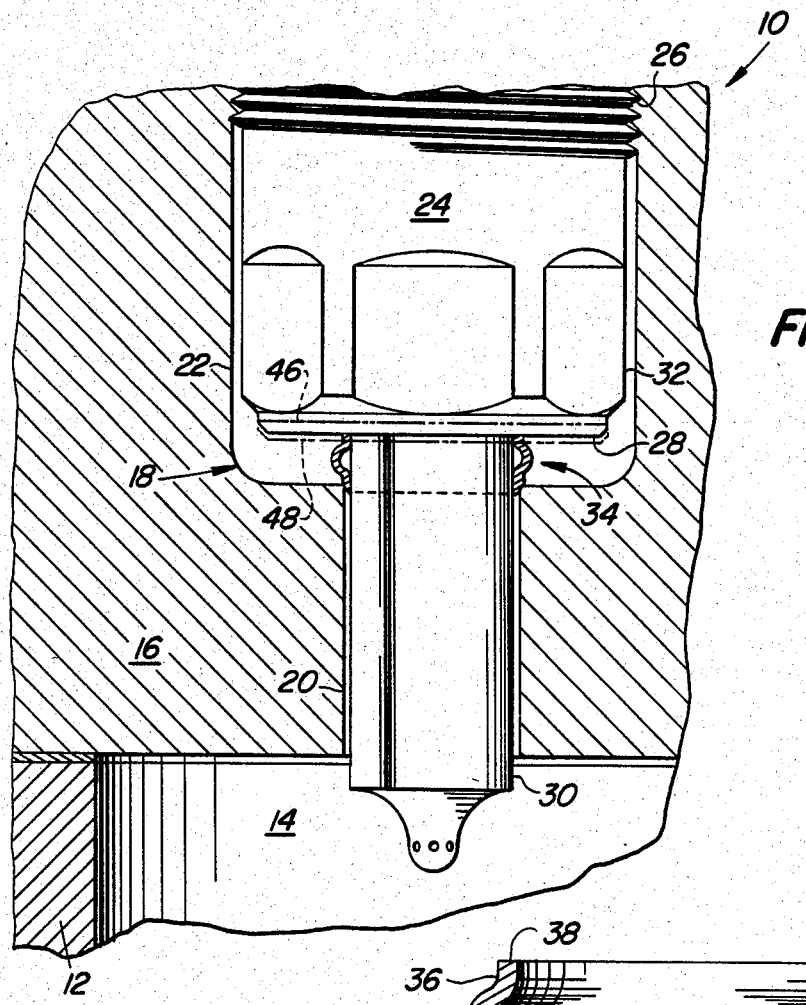
FIG. 1 is a cross-sectional view of a fuel injection nozzle positioned in a stepped bore formed in a cylinder head and having the seal of this invention positioned therebetween.

Referring to FIG. 1, a portion of an internal combustion engine 10 is shown which includes an engine block 12 having a cylinder 14 formed therein. A cylinder head 16 is mounted to the engine block 12 and closes off one end of the cylinder 14. The cylinder head 16 contains a stepped bore 18 having a smaller diameter portion 20 which communicates with the cylinder 14 and a larger diameter portion 22 which is located distally from the cylinder 14. A fuel injection nozzle 24 is positioned within the stepped bore 18 and is secured to the cylinder head 16 by threads 26. The threads 26 enable the fuel injection nozzle 24 to be axially positioned within the stepped bore 18. It should be noted that attachment means, other than the threads 26, can also be used to position the fuel injection nozzle 24 within the stepped bore 18. The fuel injection nozzle 24 also contains an exterior stepped configuration having a shoulder 28 formed between its steps 30 and 32, respectively. As is conventional, the smaller step 30 is a few thousandths smaller than the smaller diameter portion 20 of the stepped bore 18.

During normal engine operation, combustion gases which are generated during the combustion process within the cylinder 14 tend to flow upwards through the smaller diameter bore 20 towards the larger diameter bore 22. Such upward progression of these combustion gases can be detrimental in that they can cause the upper portion of the fuel injector nozzle 24 to be heated as well as the possibility of causing carbonization problems. Furthermore, if the combustion gases enter the larger diameter portion 22, one will notice that a dead volume of air will be present which will have a quenching effect on future combustion cycles. The combination of the heating of the fuel injection nozzle 24, the quenching effect of the dead volume of air, and the carbonization problem will adversely effect the efficiency of the engine 10 and increase its emission level.

In order to prevent the passage of combustion gases from the cylinder 14 into the larger diameter portion 22 of the stepped bore 18, a seal 34 is utilized. The seal 34, best shown in FIGS. 2 and 3, has the form of a hollow tubular ring 36 which is circumferentially positioned around and contacts the smaller diameter portion 30 of the fuel injection nozzle 24. The ring 36 has a flat first end 38 which abuts the shoulder 28 of the fuel injection nozzle 24 and a tapered second end 40 which contacts the smaller diameter portion 20 of the stepped bore 18. The taper is formed on the exterior surface of the ring 36 and has a maximum outside diameter which is slightly larger than the smaller diameter portion 20 of the stepped bore 18. The taper also has a minimum outside diameter which is slightly smaller than the smaller diameter portion 20 of the stepped bore 18. The taper can be machined into the ring 36 at various angles but preferably, it should be between 10 and 45 degrees as measured from the exterior surface of the ring 36. More preferably, the taper should be about 30 degrees as measured from the exterior surface of the ring 36.

Figure 2:
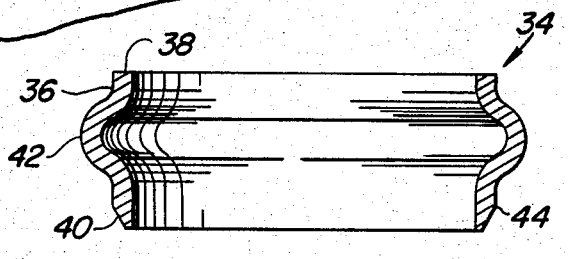
FIG. 2 is an enlarged cross-sectional view of the seal.
Figure 3:
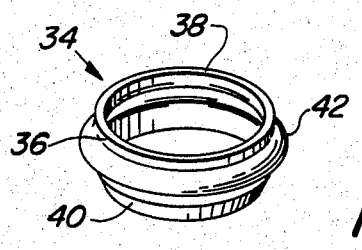
FIG. 3 is a perspective view of the seal.

The seal 34 also contains an outwardkly projecting bulge 42 located between the first and second ends 38 and 40, respectively. The bulge 42 can be located approximately in the middle of the ring 36 and more preferably, halfway between the first end 38 and the start of the tapered second end 40, that point being designated 44, see FIG. 2. The bulge 42 enables the first and second ends 38 and 40, respectively, to move axially relative to one another as the fuel injection nozzle 24 is tightened into the cylinder head 16 and during thermal expansion which occurs during normal engine operation. For example, when the seal 34 has a height dimension of about 6 millimeters, it shold be able to tolerate compression of between 0.1 to 2.5 millimeters. It is also preferable to construct the seal 34 so that it contains a relatively uniform thickness between the first end 38 and the start of the taper 44. The uniform thickness permits easy and economically manufacture of the seal 34. As is best shown in FIG. 2, the cross-sectional area of the bulge 42 is semi-circular in configuration. Although the semicircular configuration is easy to produce, it should be obvious to those skilled in the art that other cross-sectional configurations can also be utilized.

Upon initial installation of the fuel injection nozzle 24 into the stepped bore 18, it is likely that the shoulder 28 would be axially aligned with the dotted horizontal line 46. As a finer adjustment is made on the fuel injection nozzle 24, the location of the shoulder 28 would move downward towards the cylinder 14 as is shown in FIG. 1. During the operational cycle of the engine, the location of the shoulder 28 could move upward or downward between the dotted lines 46 and 48 due to thermal expansion and contraction of the assembled parts and due to the stresses which can build up within the cylinder head 16. It should be noted that the seal 34 allows for this dimensional change by having the ability to compress as the fuel injection nozzle 24 moves downwards toward the cylinder 12 and to extend back to its normal length as the fuel injection nozzle 24 returns to its initial position. Under normal operating conditions, the seal 34 will prevent the combustion gases, which are generated in the cylinder 24, from passing into the larger diameter portion 22 of the stepped bore 18.

Although the seal 34 is constructed of a metal material, it can also function as a heat seal by preventing the hot combustion gases from entering the dead air space within the larger diameter portion 22. The metal material could also be replaced with a heat resistant rubber or plastic material provided such a material is found which can withstand the normal temperature range of an operating engine, which is roughtly 300–600 degrees Farenheit.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. A seal for sealing a smaller diameter portion of a stepped bore from a larger diameter portion of said stepped bore, said stepped bore having a fuel injection nozzle with an exterior stepped configuration secured therein in a predetermined axial position, said nozzle having a shoulder formed between its steps, said seal comprising:

(a) a tubular ring circumferentially positioned around a smaller diameter portion of said fuel injection nozzle, said ring having a flat first end abutting said shoulder of said fuel injection nozzle, a tapered second end contacting the smaller diameter portion of said stepped bore and an internal surface having portions adjacent opposite ends of the ring extending parallel to and contacting the surface of the smaller diameter portion of the nozzle, said taper being formed on an exterior surface of said ring and having a maximum outside diameter slightly larger than the smaller diameter portion of said stepped bore; and (b) an outwardly projecting bulge formed between and spaced from said first and second ends which will resiliently deform and permit said ends to move axially relative to one another as said nozzle is axially secured into said stepped bore, the internal surface of the ring being spaced from the nozzle in the area of the bulge.

2. The seal of claim 1 wherein said ring has a uniform thickness between said first end and the start of said taper.

3. The seal of claim 2 wherein said bulge is formed approximately halfway between said first and second ends.

4. The seal of claim 3 wherein said bulge has a semicircular cross-sectional configuration.

5. A seal for an internal combustion engine, said engine including an engine block having a cylinder formed therein, a cylinder head mounted to said block which closes off one end of said cylinder, said cylinder head having a stepped bore formed therein with a smaller diameter portion communicating with said cylinder and a larger diameter portion located distally from said cylinder, and a fuel injection nozzle positioned in said stepped bore and being secured to said cylinder head in a predetermined axial position, said fuel injection nozzle having an exterior stepped configuration with a shoulder formed between its steps, said seal comprising:

(a) a tubular ring circumferentially positioned around a smaller diameter portion of said fuel injection nozzle, said ring having a flat first end abutting said shoulder of said fuel injection nozzle, a tapered second end contacting the smaller diameter portion of said stepped bore, and an interior surface having portions adjacent the opposite ends of the ring extending parallel to and contacting the surface of the smaller diameter portion of the nozzle, said taper being formed on an exterior surface of said ring and having a maximum outside diameter slightly larger than the smaller diameter portion of said stepped bore; and (b) an outwardly projecting bulge formed between and spaced from said first and second ends which will resiliently deform and permit said ends to move axially relative to one another as said fuel injection nozzle is axially secured to said cylinder head and during normal operation of said engine, the internal surface of the ring being spaced from the nozzle in the area of the bulge, said seal preventing combustion gases generated in said cylinder from flowing into the larger diameter portion of said stepped bore.

6. The seal of claim 5 wherein said ring has a uniform thickness between said first end and the start of said taper.

7. The seal of claim 6 wherein said bulge is formed approximately halfway between said first and second ends.

8. The seal of claim 7 wherein said bulge has a semicircular cross-sectional configuration.

9. The seal of claim 5 wherein said second end is tapered about 10–45 degrees as measured from the exterior surface of said ring.

10. The seal of claim 9 wherein said second end is tapered approximately 30 degrees as measured from the exterior surface of said ring.

* * * * *